US006216618B1

(12) United States Patent
Goldberg et al.

(10) Patent No.: US 6,216,618 B1
(45) Date of Patent: Apr. 17, 2001

(54) EMBROIDERY SYSTEM UTILIZING WINDOWS CE BASED GUI

(75) Inventors: Brian Goldberg, Thornhill; Anastasios Tsonis, Kitchener, both of (CA); Ben Chia, Jr., Mandave (PH)

(73) Assignee: Pulse Microsystems Ltd., Mississauga (CA)

( * ) Notice: Subject to any disclaimer, the term of this patent is extended or adjusted under 35 U.S.C. 154(b) by 0 days.

(21) Appl. No.: 09/543,960

(22) Filed: Apr. 7, 2000

(51) Int. Cl.[7] ..... D05B 19/12; D05C 5/06

(52) U.S. Cl. ..... 112/470.04; 112/102.5; 112/155; 112/475.19; 700/138

(58) Field of Search ..... 112/470.04, 470.01, 112/470.06, 102.5, 155, 475.19, 475.01; 345/347; 700/138

(56) References Cited

U.S. PATENT DOCUMENTS

| | | | | |
|---|---|---|---|---|
| 4,955,305 | * | 9/1990 | Garnier et al. | 112/475.05 |
| 5,029,539 | * | 7/1991 | Yokoe et al. | 112/102.5 |
| 5,586,134 | | 12/1996 | Das et al. . | |
| 5,865,134 | | 2/1999 | Okuyama et al. . | |
| 5,910,802 | * | 6/1999 | Shields et al. | 345/347 |
| 5,924,372 | | 7/1999 | Okuda et al. . | |
| 5,924,374 | | 7/1999 | Mori et al. . | |
| 5,988,083 | | 11/1999 | Tomita et al. . | |
| 6,012,402 | | 1/2000 | Sekine . | |
| 6,016,758 | * | 1/2000 | Tomita | 112/470.04 |

* cited by examiner

*Primary Examiner*—Peter Nerbun
(74) *Attorney, Agent, or Firm*—Lawrence G. Kurland, Esq.; Bryan Cave LLP

(57) ABSTRACT

An embroidery system having an embroidery machine for automatically stitching embroidery stitch patterns on a garment and a machine controller for selectably controlling the operation of the embroidery machine in response to user provided selections, the improvement involves the use of a Windows CE based graphical user interface, such as a PDA, which is located between the user and the machine controller to provide user selections through the graphical user interface for directing the machine controller. The embroidery system has an associated embroidery functionality and the graphical user interface has a defined system architecture which may selectably enhance the embroidery system functionality by selectably adding software modules to the graphical user interface, such as to control the creation of embroidery lettering, to provide maintenance monitoring either locally or over the Internet, or to enable communication with the embroidery machine over a network.

10 Claims, 9 Drawing Sheets

EMBROIDERY SYSTEM UTILIZING WINDOWS CE BASED GUI

BACKGROUND OF THE INVENTION

1. Field of the Invention

The present invention relates to embroidery systems and methods and particularly to improvements in such systems and methods through the use of a Windows CE based graphical user interface.

2. Description of the Prior Art

Embroidery systems having an embroidery machine for automatically stitching embroidery stitch patterns on a garment are well known in the art, including such systems employing microprocessor control to create customized embroidery patterns, such as disclosed in U.S. Pat. Nos. 6,012,402; 5,988,083; 5,865,134; 5,924,374; and 5,924,372. In addition, such prior art systems have employed an embedded ROM for the control software, such as disclosed in U.S. Pat. No. 5,586,134, as well as using removable ROM cards to store embroidery pattern data, such as disclosed in U.S. Pat. No. 5,988,083. However, none of these prior art systems known to applicants have employed a flexible graphical user interface having the stability or on/off characteristics provided through Windows CE nor separated the user interface from the system controller in such a manner in which the graphical user interface has such characteristics and further enables the system functionality of the embroidery system to be readily enhanced by selectably adding software modules to the graphical user interface, such as, for example, to provide maintenance monitoring of the embroidery system locally or over the Internet or to enable communications with the embroidery machine over a network. These disadvantages of the prior art are overcome by the present invention through the use of a Windows CE based graphical user interface or GUI disposed between the user and the machine controller in which the graphical user interface has a defined system architecture which may be selectably enhanced through the addition of software modules to selectably enhance the system functionality of the embroidery system.

Existing embroidery machines are built with a machine controller that includes a user interface for the machine operator to control the machine. Typical functions handled by the user-interface include loading a design to be stitched, assigning appropriate thread colors for various parts of the design, executing machine commands such as trims, speed changes, start and stops etc. The user interfaces are traditionally not graphical in nature. These machines typically do not have automatic functionality to collect production data (number of stitches sewn, up-time and down-time of the machine, cause of down time (thread breakages etc.)). Additionally, these machines have traditionally not been created with built-in network functionality.

The lack of graphical user interface makes the operation of an embroidery machine difficult and requires skill and sophistication on the operator's part. Also, in large embroidery factories with large collections of embroidery machines, the ability to network embroidery machines and the collection of production data to monitor productivity in the plant is of great importance.

Attempts to solve this problem include creating a new m/c controller with custom hardware and softwares and replacing the machine controller with a PC and software running on the PC for the GUI. This approach solves the problem of the lack of graphical user interfaces; however, this approach has drawbacks in that the machine controller is an important and complicated part of the embroidery machine and replacing machine controllers is expensive since it involves a long design life cycle. Further, designing a graphical user interface with custom hardware and software requires skill and sophistication and is a process with significant risk. Since the machine controller cannot be replaced trivially, retrofitting machines in the field with new technology is not possible.

In another approach, a personal computer (PC) is used as a machine controller. Some additional hardware is required to drive the embroidery machine. The user interface for the machine controller is built as an application running on the native operating system of the PC. Typically, these operating systems have been either Microsoft Windows 3.1, Windows 95, or Windows 98. While this approach overcomes the disadvantage of designing custom hardware and software to create the graphical user interface, it still suffers certain drawbacks. Traditionally, the operating systems on traditional personal computers are generally not robust as they have not been designed to run in an industrial environment where significant down times are not acceptable. Moreover, Windows operating systems have significantly high boot (startup sequences) times which means first turning on the embroidery machine which takes a long time (greater than one minute). For the same reason as in the first approach, retrofitting existing machines in the field is not possible.

The present invention presents a new and unique improvement to an embroidery machine. The invention has two parts. The first part of the invention relates to a Windows CE based front end to create a graphical user interface to replace the user interface of the existing machine controller, and an interface to the existing machine controller for the purpose of controlling the embroidery machine. This interface preferably consists of a serial connection from the Windows CE based front end and the existing machine controller for the purposes of communicating commands, and a software protocol definition and implementation that specifics the rules for communication. The second part of the invention relates to a plug-in interface that allows the selective addition of software components that enhance the embroidery functionality of the embroidery machine to optionally perform functions such as: a) production monitoring; b) maintenance monitoring; c) embroidery design creation; and d) embroidery machine networking.

The advantage offered by a Windows CE based front end provides the advantage of fast boot times as well as a simpler and more robust operating systems that can perform reliably in an industrial setting. Further, retrofitting existing machines with new technology in accordance with the present invention merely involves plugging the Windows CE based computer with the interface into the machine controller with a simple serial connection and loading the software that implements the communication protocol into the machine controller memory. The software plug-in interface allows a modular expansion of the embroidery functionality of the embroidery machine, thus enabling the construction of different configurations for different consumers.

SUMMARY OF THE INVENTION

In an embroidery system having an embroidery machine for automatically stitching embroidery stitch patterns on a garment and a machine controller for selectably controlling the operation of the embroidery machine in response to user provided selections, the improvement involves the use of a Windows CE based graphical user interface, such as a PDA, which is located between the user and the machine controller to provide user selections through the graphical user interface for directing the machine controller. The embroidery system has an associated embroidery functionality and the graphical user interface has a defined system architecture which may selectably enhance the embroidery system functionality by selectably adding software modules to the graphical user interface, such as to control the creation of embroidery lettering, to provide maintenance monitoring either locally or over the Internet, or to enable communication with the embroidery machine over a network.

DETAILED DESCRIPTION OF THE PREFERRED EMBODIMENT

Figure 1:
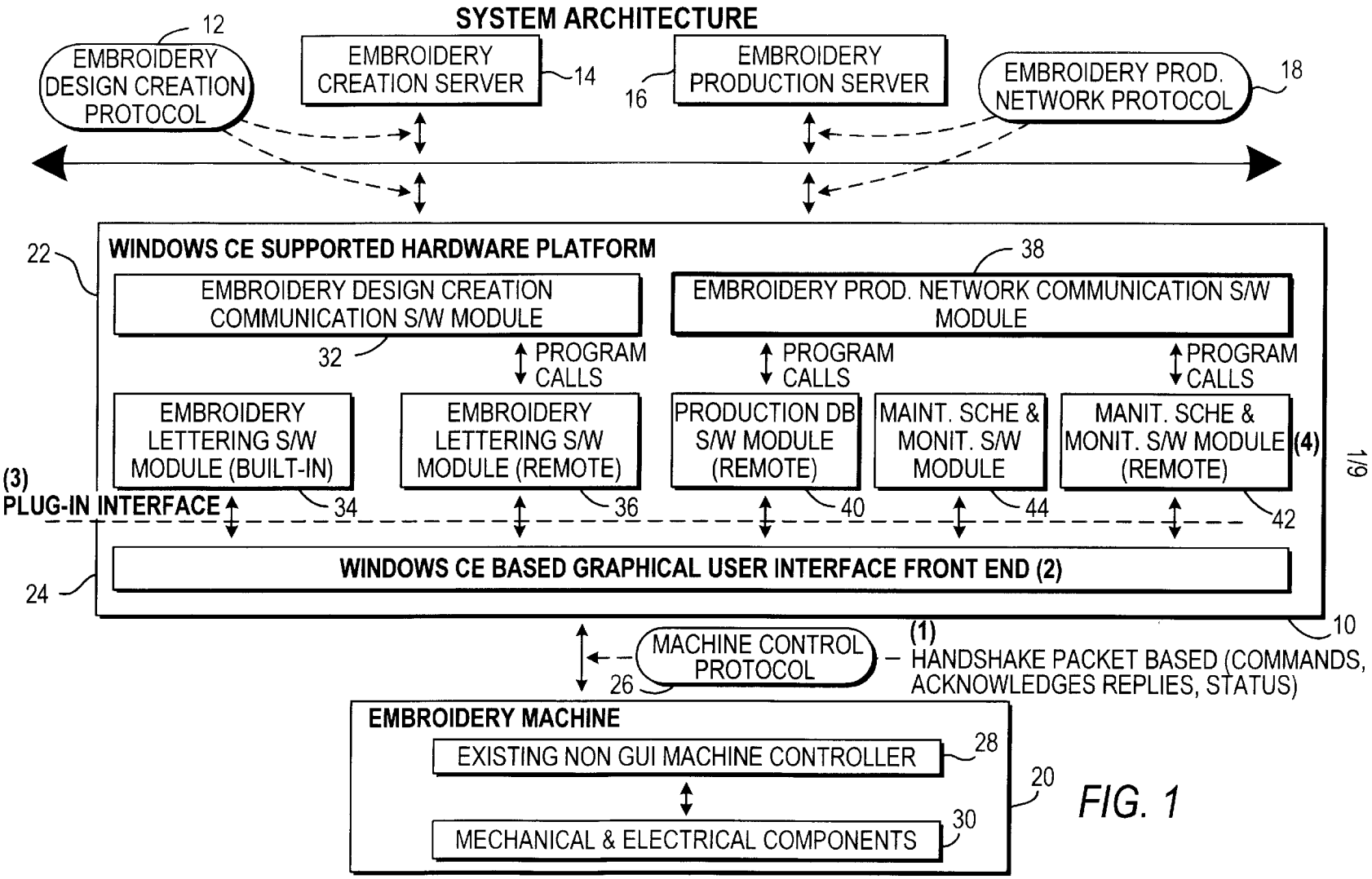
FIG. 1 is a graphical illustration of the presently preferred system architecture for an improved embroidery system in accordance with the present invention.
Figure 2:
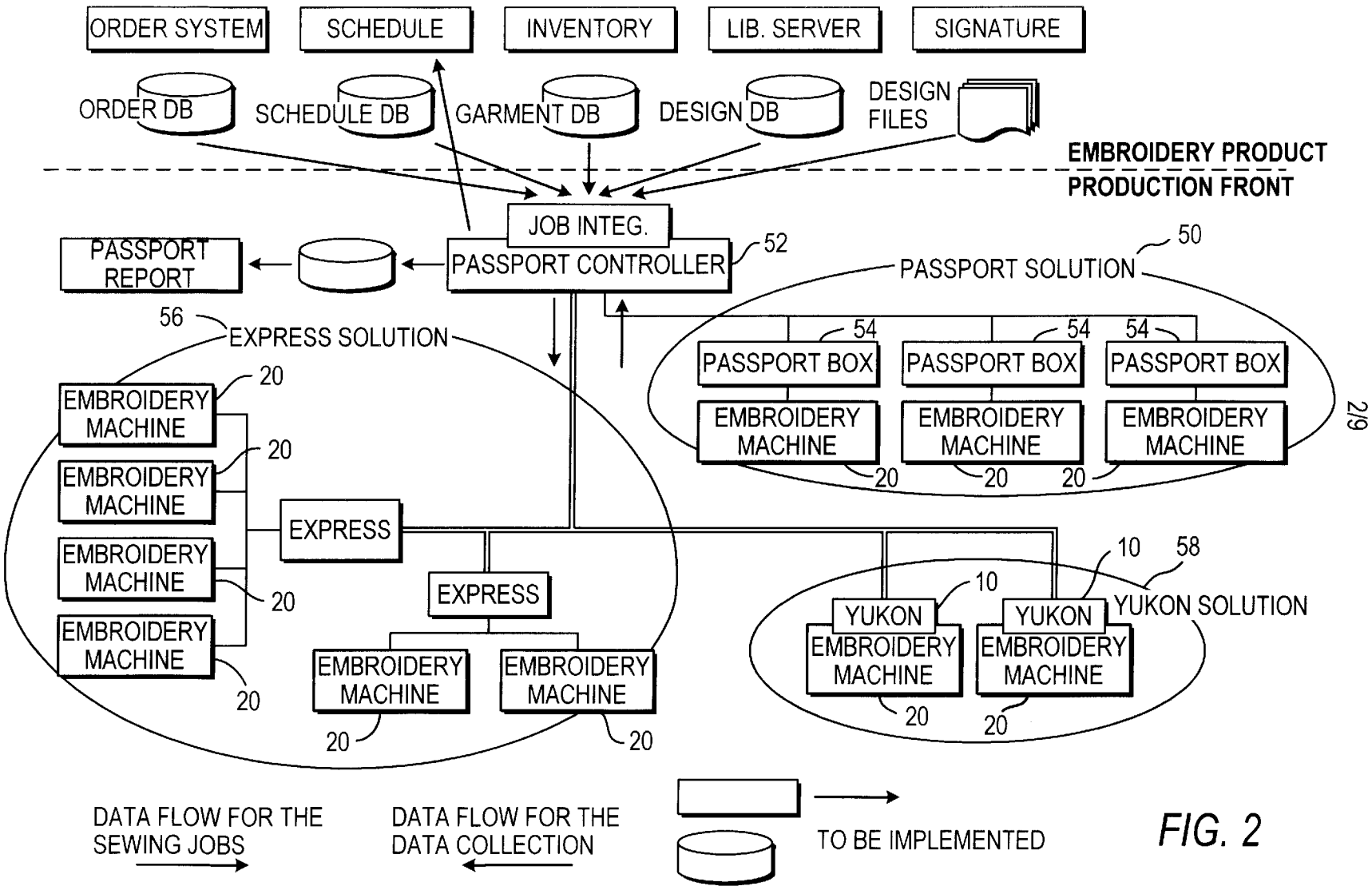
FIG. 2 is a system flow diagram for carrying out the presently preferred method of the present invention utilizing the system architecture of FIG. 1.

Referring now to the drawings in detail, and initially to FIGS. 1 and 2, the presently preferred system and method of the present invention, in which a Windows CE based graphical user interface, such as a conventional type of PDA 10, is employed is shown. FIG. 1 illustrates the presently preferred embroidery system architecture which may be employed with Pulse Signature available from Pulse Microsystems. As shown and preferred in FIG. 1, the system architecture includes a group of conventional system components arranged in a unique manner through the use of the presently preferred graphical user interface 10. The grahical user interface 10 has a Windows CE supported hardware platform 22 and a Windows CE based graphical user interface front end 24. The preferred system architecture of the Windows CE supported hardware platform 22 includes an embroidery design creation protocol 12 and an embroidery production network protocol 18 which are used to interface with an embroidery creation server 14 and an embroidery production server 16 through a network medium. The front end 24 preferably interfaces with a conventional microprocessor controlled embroidery machine 20, such as available from Tajima, through which machine control protocol 26 is provided to an existing non-graphics user interface or non GUI machine controller 28 and, therefrom, controls the conventional mechanical and electrical components 30 of the embroidery machine 20.

The preferred embroidery creation server 14 provides the fill functionality available within the Pulse Signature line of products available from Pulse Microsystems, including, but not limited to, stitch file generation and manipulation, auto-digitization, lettering, 3D rendering, file conversion, and the generation and manipulation of outline files. The currently preferred embroidery creation server 14 is an Internet enabled embroidery design creation server which encapsulates the Pulse Signature embroidery design engines and functionality in a Component Object Model architecture, or COM object, as specified by Microsoft. The COM object provides a non-GUI interface for creating embroidery designs, which is utilized by a web based application, such as an Active Server Page application, made available by a web server, such as Internet Information Server. The COM object may also be called directly by applications supporting COM as specified by Microsoft. The web server thus presents the embroidery creation server 14 interface via the conventional HTTP protocol which is used by the embroidery design creation communication software or S/W module 32, or EDC S/W module, through the embroidery design creation protocol 12 or EDC protocol. The EDC protocol 12 provides an interface between the EDC S/W module 32 and the embroidery creation server 14.

The preferred EDC protocol 12 is a conventional socket based communication protocol, which preferably operates via the conventional HTTP protocol over a TCP/IP network. The EDC S/W module 32 preferably connects to the embroidery creation server 14 and formulates EDC protocol 12 commands in the conventional HTTP protocol using HTTP headers and parameter passing. The web-based application in embroidery creation server 14 receives the EDC protocol 12 commands and issues the requested embroidery creation server 14 operations. The currently preferred EDC protocol 12 allows the EDC S/W module 32 to perform remote operations such as to open and browse an embroidery design database, to request an embroidery design creation service, an editing or modification service, or a conversion service. Each service is called and passed the necessary parameters for the embroidery creation server 14 non-GUI interface via the EDC protocol 12, such as source embroidery design data, embroidery lettering elements, including the element's text, font, position and envelope, or each embroidery design element to merge, including that element's stitch data, position and stop information, as well as editing information such as resizing or rotating, or conversion commands for stitch file format conversion or auto-digitization. The EDC protocol 12 also allows the EDC S/W module 32 to retrieve generated embroidery designs, stored designs, design information and font data from the embroidery creation server 14.

The embroidery production server 16 provides services supporting embroidery design production and process control. The preferred embroidery production server 16 is a fully integrated version of the Passport Embroidery Network Librarian Server, Passport Controller and Pulse Business Manager applications available from Pulse Microsystems. The embroidery production server 16 provides a database of embroidery designs as available in Passport Librarian Server, an embroidery production database as in Passport Controller, and production and maintenance schedule databases as in Pulse Business Manager. The current preferred embroidery production server 16 is a suite of server applications which implement the embroidery production network protocol or EPN protocol 18, a conventional socket based communication protocol which allows the embroidery production network communication S/W module or EPN S/W module 38 to connect to the server, and to open and maintain one or more sessions to process requests, and to close the sessions and connections when they are no longer needed. The currently preferred embroidery production server 16 communicates, using the EPN protocol 18, directly with any embroidery production client, such as the EPN S/W module 38, using conventional socket communications over a standard TCP/IP network. The EPN communications S/W module 38 contains a Windows CE implementation of the client non-GUI functionality provided by Passport Librarian Client and Passport Smart Box applications, as available from Pulse Microsystems, to utilize the EPN protocol 18. The EPN protocol 18 allows the EPN S/W module 38 to open an embroidery production or maintenance scheduling database to extract a production or maintenance schedule. The EPN protocol 18 also allows access to embroidery design databases, to search or browse designs, extract designs for processing or sewing, or to store modified or new designs. Additionally, the EPN protocol 18 allows access to an embroidery production database; to send production status to embroidery production monitoring workstations using Passport Status, as available from Pulse Microsystems; or to save production information such as sewing progress, start and end time, and production events such as thread and needle breaks, as a Passport Smart Box or Pulse Signature Express application, as available from Pulse Microsystems.

The presently preferred machine control protocol 26 is an embroidery specific communication protocol, which allows the Windows CE, based GUT front end 24, to control and enhance the functionality of embroidery machine 20. The presently preferred machine control protocol 26 provides communication via handshake packet based commands, acknowledgment replies, and status messages. The machine control protocol establishes a Master-Slave relationship between the GUI front end 24 and the non-GUI machine controller 28, by which the GUI front end 24 sends commands conventionally translated by the non-GUI machine controller 28 into embroidery machine operations. The presently preferred machine control protocol 26 allows the GUI front end 24 to perform machine controller operations. The controller operations performed are the same as those performed by conventional embroidery machine controllers, such as available from Tajima, and include the ability to manage embroidery machine memory slots; to load embroidery designs into the embroidery machine for sewing; to set embroidery machine parameters; to set sewing parameters such as the needle bar, manual or automatic color changes and other common sewing parameters; to control the starting, stopping and speed of the sewing process; to inform the embroidery machine operator of errors; to step sequentially through the embroidery design, forwards or backwards by stitches or stops; to control the movement of the embroidery machine frame, to move left, right, forwards or backwards, trace designs, or return to origin. The machine control protocol 26 also provides the ability for the non-GUI machine controller 28 to send embroidery machine status and error messages to be displayed graphically via the Windows CE based GUI front end 24.

As shown and preferred in FIG. 1, the Windows CE based hardware platform 22 includes a series of software or S/W modules, some of which may be built in and others of which may be added. The presently preferred Windows CE based hardware platform 22 includes the embroidery design creation communication software module 32 and the embroidery production network communication software module 38, as architectural components upon which other S/W modules can be dependent. The preferred Windows CE based GUI front end 24 provides a plug-in interface, an embroidery specific Active X defined common interface by which the Windows CE based GUI front end 24 can communicate with each S/W module. The Windows CE based GUI front end 24 communicates with both embroidery design creation software modules and embroidery production software modules through this standard interface to provide the computer-aided design capabilities of Pulse Signature line of applications, and the computer-aided manufacturing capabilities of Passport line of applications, available from Pulse Microsystems. These S/W modules also provide additional GUI to the Windows CE GUI front end 24 for extended functional capabilities.

Embroidery lettering S/W modules 34 and 36 control the embroidery functionality of the embroidery design system in a conventional manner and allow for the generation of embroidery designs with lettering. A built-in embroidery lettering S/W module 34 provides embroidery design creation functionality on the Windows CE hardware without requiring a connection to the embroidery creation server 14. This is accomplished by designing the embroidery lettering GUI and a Windows CE version of the existing lettering and stitch generation engines of Pulse Signature and placing them in a built-in embroidery lettering S/W module 24. A remote embroidery lettering S/W module 36 contains the embroidery lettering GUI and uses conventional program calls to the embroidery design creation communications S/W module 32, which, in turn, provides the embroidery design creation functionality by calling the embroidery creation server 14 through the EDC protocol 12. Similarly, a production DB software module 40 and maintenance scheduling and monitoring S/W modules 42 and 44 provide production software support for the GUI front end 24. The production DB S/W module 40 provides embroidery production report capabilities such as those provided by standard Passport Smart Box or Pulse Signature Express Data Collection, production scheduling capabilities, as provided by Pulse Business Manager, and Passport Librarian Client capabilities, as available from Pulse Microsystems, to save production information to the embroidery production database, to access production schedule database information, and to access a Passport Librarian Database. The production DB S/W module contains the GUI and command functionality to call the EPN communication software module 38, by using conventional program calls to interface with the embroidery production server 16 through the EPN protocol 18. A built-in maintenance schedule and monitoring S/W module 44 encapsulates the maintenance schedule and monitoring GUI and the maintenance and monitoring engine for accessing and modifying locally stored maintenance information and for monitoring and storing production history. A remote maintenance schedule and monitoring S/W module 42 shares the same GUI as the built-in module 44, but uses the EPN communications module 38 to communicate with the embroidery production server 16 to access the remote maintenance schedule database and perform monitoring of production history.

Referring now to FIG. 2, it should be noted that there are three solutions which could be employed in the production front. One is the conventional Passport solution 50 available from Pulse Microsystems in which the conventional Passport Controller 52 and Passport Box 54 are employed. Another solution is the conventional Express solution 56 available from Pulse Microsystems. This solution links a normal PC computer and existing embroidery machine 20 with a serial communication port but does not, for example, integrate Pulse embroidery control software t6o the machine level; e.g., the needle bar selection and embroidery job properties are not sent to the embroidery machine 20 directly. As shown and preferred in FIG. 2, the Pulse Express solution 56 and the solution of the present invention, termed the Yukon solution 58, are linked together through the Passport Controller 52 to enable the sewing jobs to flow directly to the embroidery machine 20. The so called Yukon solution 58 employs the presently preferred Windows CE based GUI interface 10 of FIG. 1.

Figure 3:
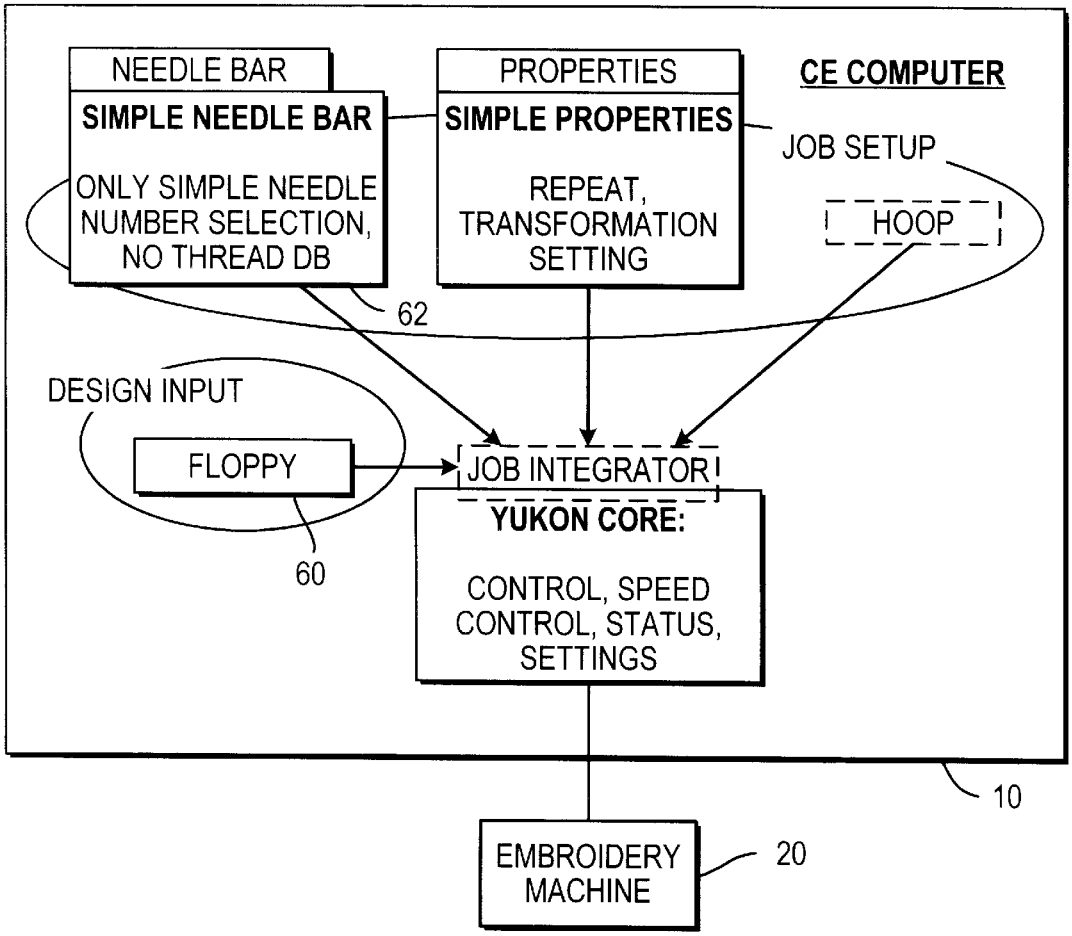
FIG. 3 is a graphical illustration of the basic Windows CE based graphical user interface employed in the presently preferred system and method for carrying out the presently preferred method of the present invention utilizing the system architecture of FIG. 1.
Figure 4:
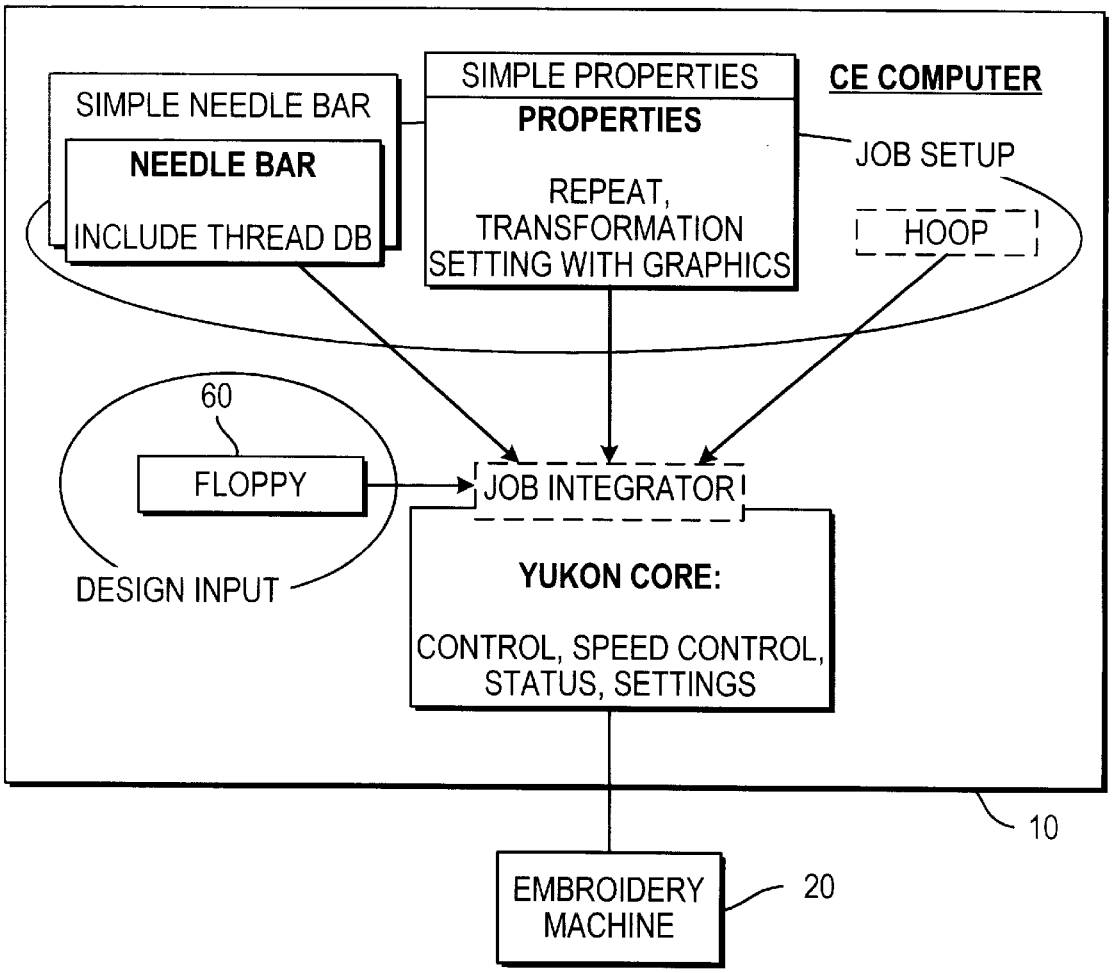
FIG. 4 is a graphical illustration, similar to FIG. 3, of an alternative embodiment of the basic Windows CE based graphical user interface employed in the presently preferred system and method.
Figure 5:
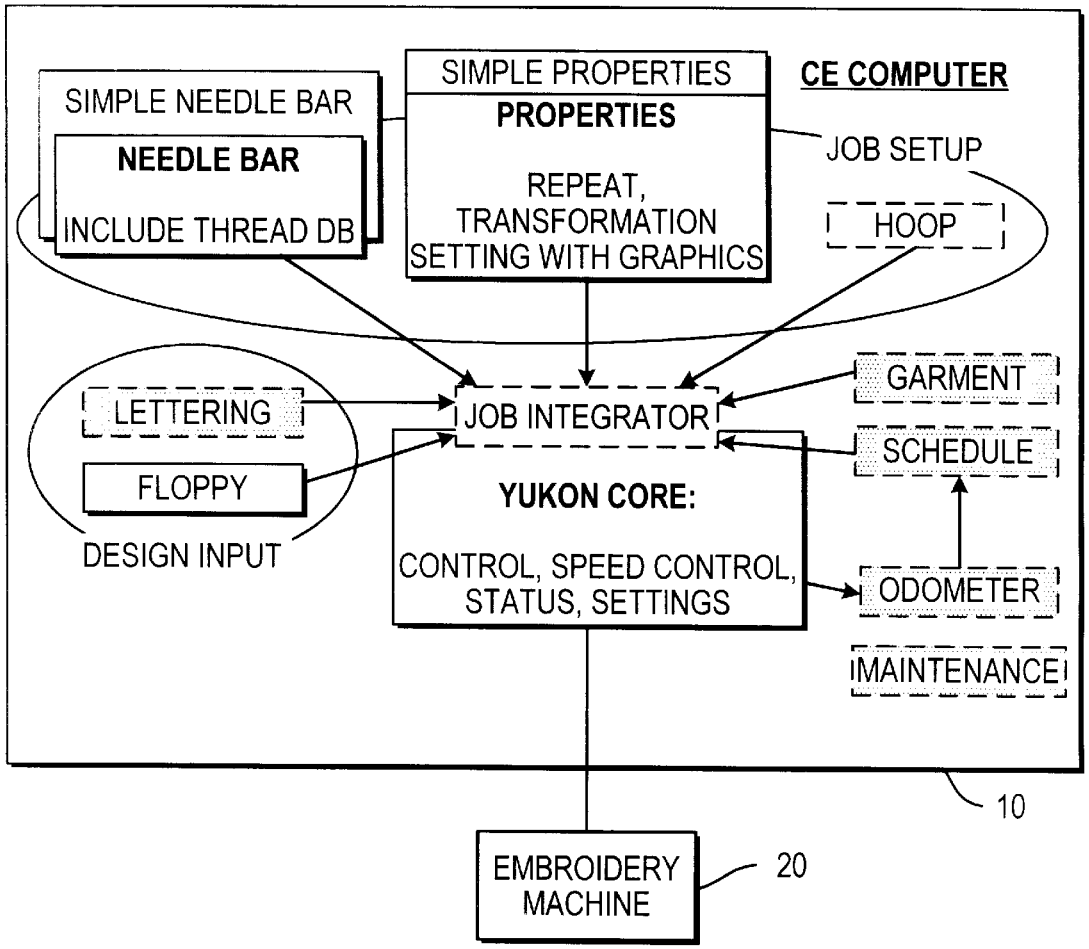
FIGS. 5 through 9 are graphical illustrations, similar to FIGS. 3 and 4, of the Windows CE based graphical user interface employed in the presently preferred system and method, employing various changeable software modules to control embroidery system functionality.
Figure 6:
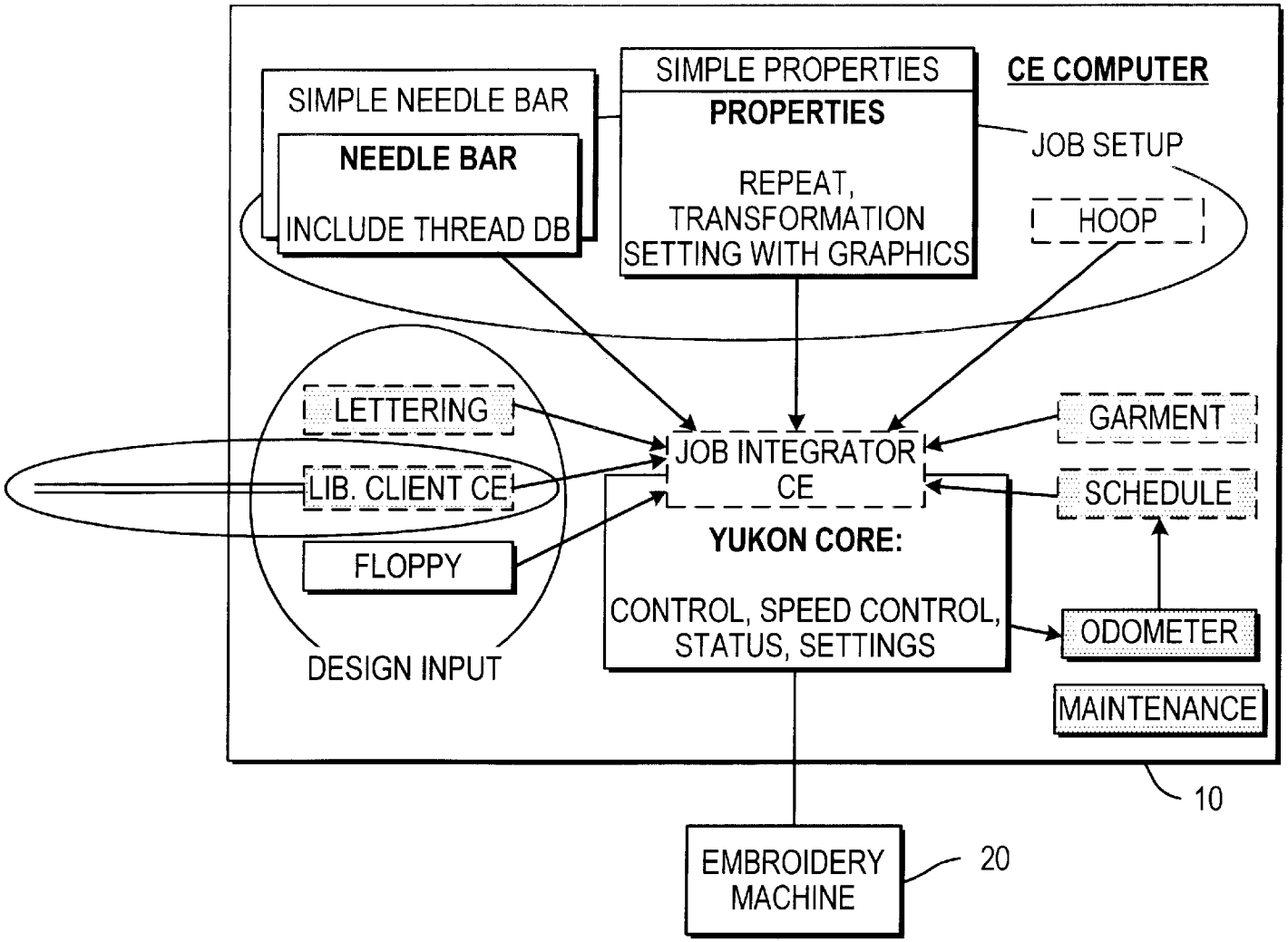
Figure 7:
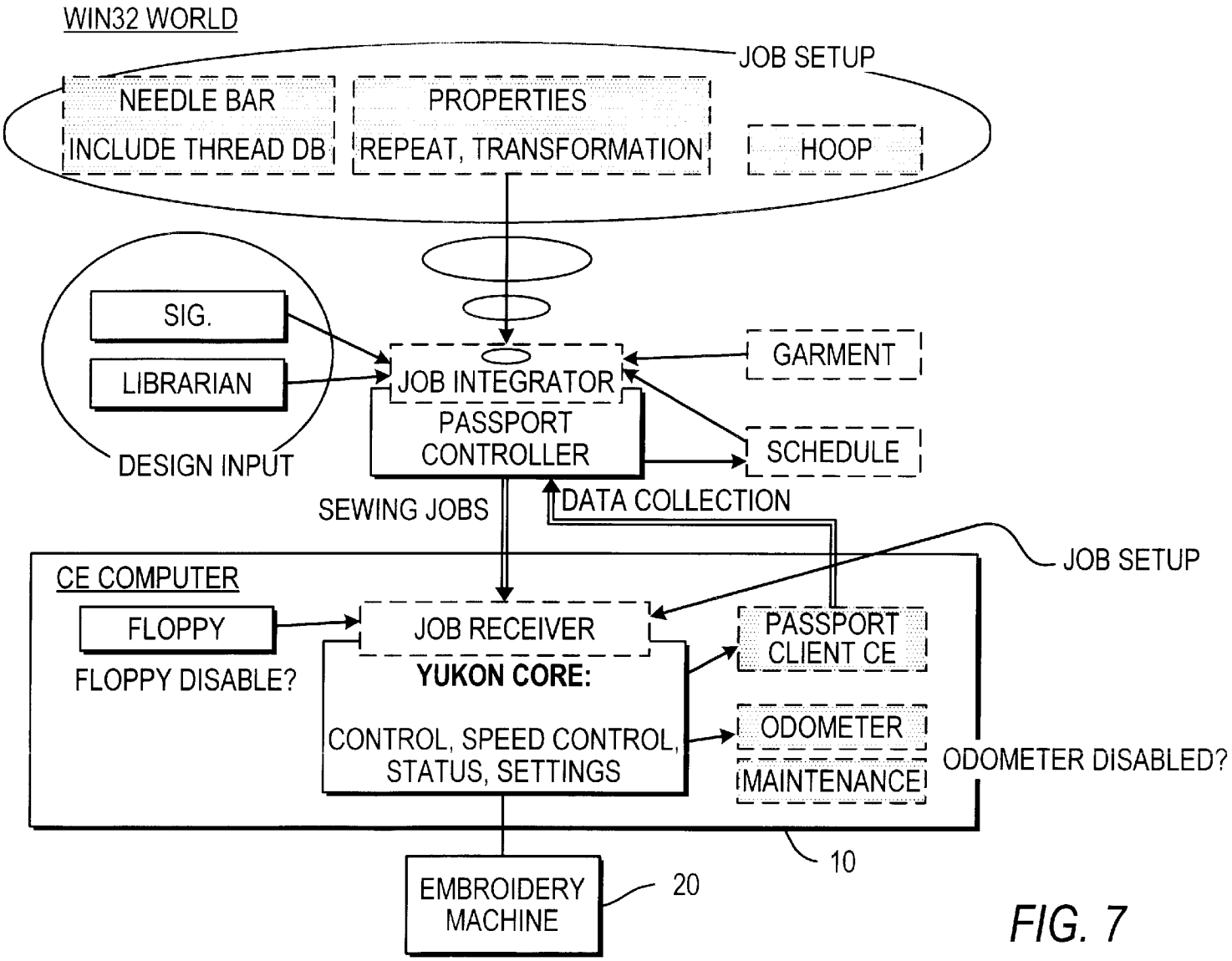

Referring now to FIGS. 3–7, various configurations of the GUI 10 are illustrated dependent on the desired functionality. FIG. 3 illustrates a basic functionality for the preferred GUI 10. The basic functionality includes a floppy 60, a simple needle bar selection 62 with needle number, color graphic display base on needle number, simple job property definition such as repeating and transformation, without graphics, control client, status, and speed control. With this basic GUI 10 arrangement, the user can input design from the floppy 60 and define the sewing job with simple needle bar selection and simple properties definition. FIG. 4 illustrates a more advanced version of the preferred GUI 10 which additionally includes needle bar selection with thread database, real color graphics base on threads, job property definition with graphics to display repeating and transformation in scale and hoop with graphics display. FIG. 5 illustrates still a more advanced version of the preferred GUI 10, adding plug in software modules for lettering, garment, schedule, odometer, and maintenance, such as illustrated in FIG. 1. FIG. 6 illustrates an even more enhanced version of the preferred GUI 10 adding Passport Librarian available from Pulse Microsystems so as to give the user Internet access to get designs from the Passport Librarian server for embroidery production. FIG. 7 illustrates the network version of the preferred GUI 10. The Passport Controller sends integrated jobs to the GUI 10 which collects the data and sends it back to Passport Controller through Passport Client for CE from Pulse Microsystems. Schedule and Passport Reporter from Pulse Microsystems share the collected data from the Passport database.

Figure 8:
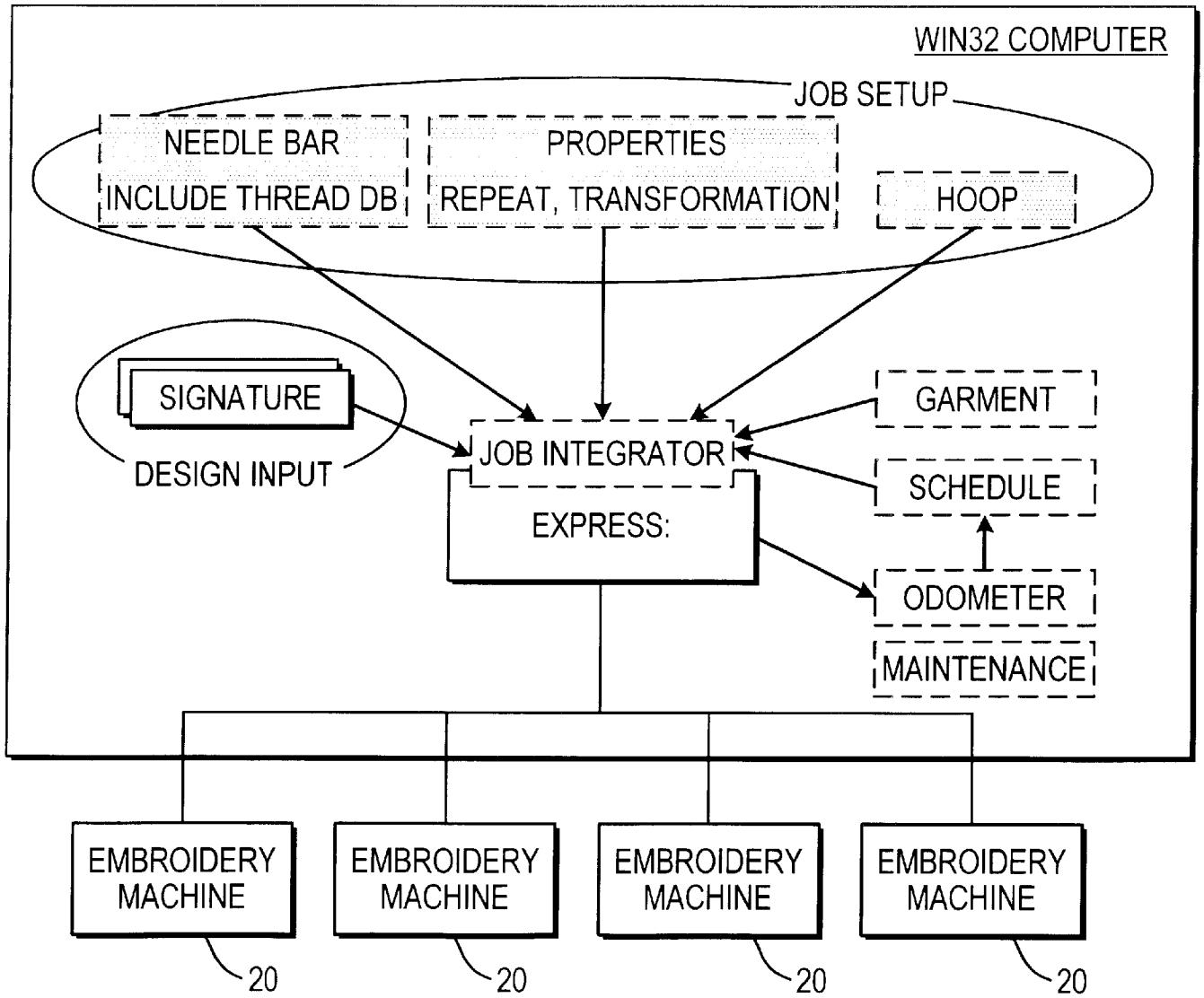
Figure 9:
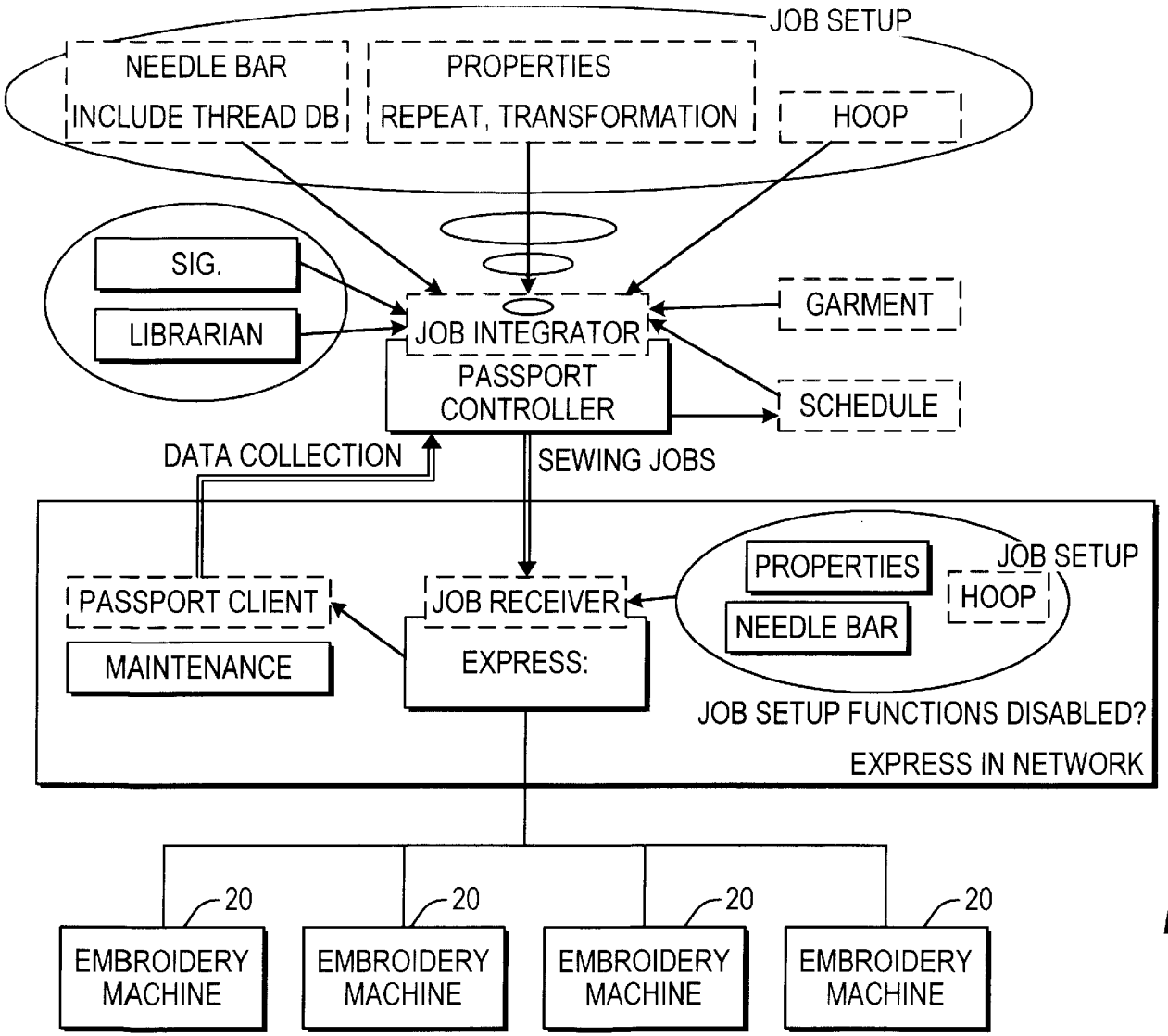

Referring now to FIGS. 8–9, various versions of Passport Express are shown with Passport Signature and Passport Librarian being software products available from Pulse Microsystems.

Thus, by employing the above architecture, a Windows CE based PDA 10 may be used as a graphical user interface between the user and the embroidery machine 20 for providing user selections through the graphical user interfaced for directing the machine controller 28, while enabling the embroidery system functionality to be selectably controlled by adding software modules to the GUI 10.

What is claimed is:

1. In an embroidery system having an embroidery machine for automatically stitching embroidery stitch patterns on a garment and a machine controller for selectably controlling the operation of the embroidery machine in response to a user provided selections; the improvement comprising a Windows CE based graphical user interface disposed between the user and the machine controller for providing said user selections through said graphical user interface for directing said machine controller.

2. The improved embroidery system in accordance with claim 1 wherein said graphical user interface comprises a PDA.

3. The improved embroidery system in accordance with claim 1 wherein said embroidery system has an associated embroidery functionality, said graphical user interface comprising a defined system architecture, said defined system architecture comprising means for selectably enhancing the system functionality of the embroidery system.

4. The improved embroidery system in accordance with claim 3 wherein said means for enhancing the system functionality comprises means for selectably adding software modules to said graphical user interface, said software modules comprising means for controlling the embroidery functionality of said embroidery system.

5. The improved embroidery system in accordance with claim 4 wherein one of said software modules comprises means for controlling creation of embroidery lettering.

6. The improved embroidery system in accordance with claim 4 wherein one of said software modules comprises means for providing maintenance monitoring of said embroidery system.

7. The improved embroidery system in accordance with claim 6 wherein said means for providing maintenance monitoring further comprises means for providing said maintenance monitoring over the internet.

8. The improved embroidery system in accordance with claim 4 wherein one of said software modules comprises a network module for enabling communications with said embroidery machine over a network.

9. A method for controlling an embroidery machine having a machine controller for enabling automatic stitching of embroidery patterns in response to user selectable inputs comprising the step of providing said user selectable inputs to said machine controller through a Windows CE based graphical user interface.

10. The method in accordance with claim 9 wherein said providing step further comprises the step of providing said user selectable inputs through a PDA graphical user interface.

* * * * *